US011933564B2

(12) United States Patent
McHann

(10) Patent No.: US 11,933,564 B2
(45) Date of Patent: Mar. 19, 2024

(54) COMPOSITE PROJECTILE BARREL

(71) Applicant: Mountain Tactical Company, Bozeman, MT (US)

(72) Inventor: Jason McHann, Bozeman, MT (US)

( * ) Notice: Subject to any disclaimer, the term of this patent is extended or adjusted under 35 U.S.C. 154(b) by 0 days.

(21) Appl. No.: 18/088,658

(22) Filed: Dec. 26, 2022

(65) Prior Publication Data

US 2023/0213299 A1 Jul. 6, 2023

Related U.S. Application Data

(60) Provisional application No. 63/295,865, filed on Jan. 1, 2022.

(51) Int. Cl.
*F41A 21/02* (2006.01)
*F41A 21/24* (2006.01)

(52) U.S. Cl.
CPC ..... *F41A 21/02* (2013.01); *F41A 21/24* (2013.01)

(58) Field of Classification Search
CPC ..... F41A 13/12; F41A 21/02; F41A 21/24; F41A 21/00–488; F28F 2001/027; F28F 1/00–44
USPC ..... D22/103, 104, 108
See application file for complete search history.

(56) References Cited

U.S. PATENT DOCUMENTS 1,759,772 A * 5/1930 Williams ..... F41A 21/10 42/77
2,361,932 A * 11/1944 Fay ..... F41A 21/24 89/14.1
5,196,637 A 3/1993 Petrovich
5,577,555 A * 11/1996 Hisajima ..... F28F 1/426 165/DIG. 515
6,510,870 B1 * 1/2003 Valaszkai ..... B21C 37/20 138/117
8,025,003 B1 * 9/2011 Saur ..... F41A 21/24 42/76.01
8,584,391 B1 11/2013 Calvert
9,528,785 B2 * 12/2016 Klett ..... F41A 21/44
D782,598 S * 3/2017 Faxon ..... D22/108
10,001,337 B2 6/2018 Curliss
(Continued)

FOREIGN PATENT DOCUMENTS

CN 110274516 A 9/2019
CN 114508963 A 5/2022
(Continued)

OTHER PUBLICATIONS

Evike. < https://web.archive.org/web/20160202094146/https://www.evike.com/products/50013/>. Feb. 2, 2016. (Year: 2016).*

*Primary Examiner* — Gabriel J. Klein
(74) *Attorney, Agent, or Firm* — Antoinette M. Tease

(57) ABSTRACT

A firearm barrel having an inner layer and a shroud. The inner layer surrounds a concentric bore and has an outer diameter. The inner layer is made up of an unperforated core that directly surrounds the concentric bore and a perforated core that surrounds the unperforated core. The shroud surrounds the perforated core, which is made up of a plurality of equilateral triangular cutouts and a plurality of circular cutouts in a grid pattern that is configured to form structural ribs between the unperforated core and the outer diameter of the inner layer. The inner layer is preferably made of steel, and the shroud is a cylindrical titanium tube.

3 Claims, 6 Drawing Sheets

(56) References Cited

U.S. PATENT DOCUMENTS

| | | | | |
|---|---|---|---|---|
| D875,874 | S * | 2/2020 | Oglesby | D22/108 |
| 10,718,586 | B2 | 7/2020 | Glisovic et al. | |
| 11,079,194 | B1 * | 8/2021 | Sinnema | F41A 21/02 |
| 2005/0229464 | A1 * | 10/2005 | Olson | F41B 11/00 42/76.02 |
| 2016/0209145 | A1 * | 7/2016 | Wolf | F41A 5/04 |
| 2020/0408477 | A1 | 12/2020 | Glisovic et al. | |
| 2022/0120528 | A1 | 4/2022 | Muceus | |
| 2022/0282948 | A1 * | 9/2022 | Remo | F41A 21/24 |

FOREIGN PATENT DOCUMENTS

| | | | | |
|---|---|---|---|---|
| DE | 19523644 | A1 * | 1/1997 | F41A 21/24 |
| EP | 4047300 | A1 | 8/2022 | |
| FR | 471426 | A * | 10/1914 | |
| WO | WO-2023203500 | A1 * | 10/2023 | F28F 1/426 |

* cited by examiner

COMPOSITE PROJECTILE BARREL

CROSS-REFERENCE TO RELATED APPLICATION

Pursuant to 35 U.S.C. § 119(e), this application claims the benefit of U.S. Provisional Application No. 63/295,865, filed on Jan. 1, 2022.

BACKGROUND OF THE INVENTION

1. Field of the Invention

The present invention relates generally to the field of firearms, and more particularly, to a composite projectile barrel for a firearm.

2. Description of the Related Art

The barrel on a firearm is typically the heaviest component of the firearm system. Traditional firearm barrels are manufactured from solid carbon steel or stainless-steel alloys. To absorb the internal stresses of combustion, these alloys must have a tensile strength that contains the initial explosion of the powder charge and the subsequent expanding gasses while having the modulus of elasticity (ductility) to avoid permanent deformation, which would lead to catastrophic failure.

The larger the diameter of the barrel, the more material there is to control these forces. When these forces are controlled, the barrel has less deformation while the projectile is traveling down the bore, resulting in greater accuracy and consistency on target. This larger diameter comes at the expense of increased weight, however.

The present invention allows for a larger diameter barrel to retain the ability to control these forces with limited deformation without the increased weight of a solid steel or stainless-steel alloy, thus creating a lightweight solution for the firearm system that is accurate and consistent. The first step in the inventive process was understanding how the force created from combustion causes elastic deformation to occur in the metal.

Newton's First Law, the "law of inertia," states that an object at rest remains at rest, and an object that is moving will continue to move straight with a constant velocity, if and only if there is no net force acting on that object. Combustion in a firearm chamber creates forces used to propel a projectile through the bore of a barrel. These forces are omni-directional and act upon the material around the projectile as well as the projectile itself. As force is applied to the internal wall of the firearm barrel, the matter of which the firearm barrel is composed begins to deform. As one segment of the barrel deforms, the deformation enacts force along the opposing axis of the barrel. This opposing clastic deformation in response to the combustion force pulls the opposing axis of the barrel back to is original shape, which enacts restoring force in the opposite direction and causes a vibration or harmonic to follow the projectile down the bore of the barrel. Until the dissipative force dampens the motion, the barrel will continue to vibrate like a tuning fork.

Because a firearm barrel has a longer linear axis to create distance for the projectile to travel, Hooke's Law of Deformation applies. The harmonic oscillation described above can be calculated using the following formula:

$$PE_{e1} = \frac{1}{2}kx^2$$

in which $PE_{e1}$ is the elastic potential energy stored in the deformed barrel, x is the displacement from equilibrium, and k is the force constant. The force constant k is directly related to the rigidity of the system. The larger the force constant k, the greater the restoring force, and the stiffer the barrel system becomes. All things being equal, the larger the outside diameter of the barrel in relation to the bore of the barrel, the larger the restorative force, thus making the barrel stiffer, more accurate and more consistent.

To keep the barrel diameter as large as possible and lower the weight of the barrel system, material needed to be removed from the barrel in a way that preserved the rigidity achieved from the larger diameter while minimizing the reduction of the restoring force. In the present invention, after this material is removed, an additional material with ideal properties is overlayed to create a face sheet. This face sheet has additional properties to increase the rigidity of the firearm barrel while adding minimal weight. Because of the nature of the materials used, heat is not insulted around the bore of the barrel, which would reduce its life cycle. Trapped heat in a firearm barrel increases metal fatigue and can cause premature failure. Instead, the present invention allows the heat to transfer away from the bore of the barrel through the weight-saving geometry, and heat can escape into the ambient atmosphere outside of the barrel. The reduction of vibration caused by the restoring forces minimizes vibration fatigue as well. The resulting firearm barrel has the rigid properties of a large diameter barrel while containing less mass than a traditional solid firearm barrel.

BRIEF SUMMARY OF THE INVENTION

The present invention is a firearm barrel comprising: an inner layer; and a shroud; wherein the inner layer surrounds a concentric bore and has an outer diameter; wherein the inner layer comprises an unperforated core that directly surrounds the concentric bore and a perforated core that surrounds the unperforated core; wherein the shroud surrounds the perforated core; and wherein the perforated core is comprised of a plurality of equilateral triangular cutouts and a plurality of circular cutouts in a grid pattern that is configured to form structural ribs between the unperforated core and the outer diameter of the inner layer. In a preferred embodiment, the grid pattern is comprised of a repeating and overlapping series of arrays; wherein each array is comprised of a central circular cutout surrounded by six equally spaced equilateral triangular cutouts, each of the equilateral triangular cutouts having three tips; wherein a circular cutout is situated at each of the three tips of each equilateral triangular cutout; and wherein each circular cutout is aligned with an axis of symmetry of each of the equilateral triangular cutouts.

In a preferred embodiment, the barrel has an outer circumference; wherein each of the equilateral triangular cutouts has a floor and three contiguous side walls; wherein the floor of each equilateral triangular cutout is concentric with the bore; and wherein the contiguous side walls of the equilateral triangular cutout are perpendicular to the outer circumference of the barrel. In another preferred embodiment, wherein each of the circular cutouts has a floor and one continuous side wall; wherein the floor of each circular cutout is perpendicular to a radius extending from a center of the central bore to a center of each circular cutout; and wherein the continuous side wall of each circular cutout is parallel to the radius extending from the center of the central bore to the center of each circular cutout. The floor of each circular cutout is preferably shallower than the floor of each equilateral triangular cutout.

In a preferred embodiment, the unperforated core has a thickness; wherein the central bare has a radius; and wherein the thickness of the unperforated core is at least equal to the radius of the central bore. Optionally, the floor of each equilateral triangular cutout comprises a fillet that extends around a perimeter of the floor. Optionally, each equilateral triangular cutout comprises a chamfer that extends around a top edge of each equilateral triangular cutout.

The inner layer is preferably comprised of steel. The shroud is preferably a cylindrical tube comprised of titanium.

REFERENCE NUMBERS

Figure 1:
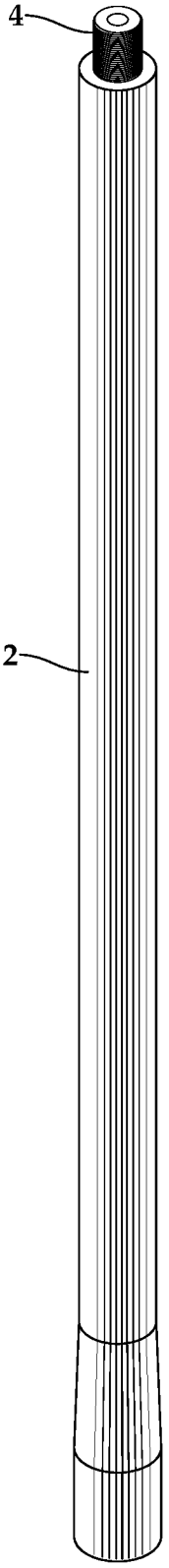
FIG. 1 is a perspective view of the present invention shown fully installed.

1 Inner layer/core
2 Outer layer/shroud
3 Central bore
4 Threaded muzzle end (of barrel)
13*a* Circle/circular cutout
13*b* Triangle/triangular cutout
13*c* Fillet
13*d* Chamfer

DETAILED DESCRIPTION OF INVENTION

A. Overview

The present invention works by creating a three-layered composite structure that has a combined property of reduced mass and high rigidity. The initial skin layer (which is the unperforated core) encompasses the bore of the barrel. This layer is directly subjected to the forces generated by the expanding combustion gasses of the burning propellant. As the force and restorative force are applied to this layer, shear forces are induced. Since a barrel is a cylinder with a bore down the central axis, the circumferential stress, or hoop stress, must be calculated to determine the necessary thickness of the initial layer. This is calculated using the Young-Laplace Equation:

$$\sigma_\theta = \frac{Pr}{c}$$

where:

P is the internal pressure;
t is the wall thickness;
r is the radius of the cylinder; and
$\sigma_g$ is the hoop force.

By solving for t, the thickness of the initial layer can be derived. The hoop force shall be less than the force necessary to damage the initial layer.

This initial layer must have a margin of safety to prevent a rupture that would allow high pressure gasses from the bore to escape the inner and outer layers. The second layer is machined from the outer face of the initial layer and is composed of equilateral triangle ribs that bridge the distance between the first and third layer. Equilateral triangle ribs transfer applied forces equally across the cylinder. This geometry creates an even mesh for forces to transfer through the material in no preferential direction and creates a lightweight yet stiff support structure for the barrel. Cylindrical cuts are made where the center points of the equilateral triangles merge to create a predictable transfer point for kinetic energy to pass through to the next nest of triangles. The cylinder provides a point of symmetry that prevents energy from taking a preferential path and causing an imbalance of force and restorative force in the barrel system. Such an imbalance could create an unpredictable harmonic that would negatively affect accuracy and consistency of the barrel system. The thicker this second layer is, the stronger the barrel system is.

The third and outer skin layer is comprised of a complimentary material with attributes that augment the lightweight nature of the invention while increasing strength, accuracy, and consistency. Force and restorative forces applied to the barrel system induce compression forces on the outer skin; therefore, a lightweight material with excellent compressive strength (such as titanium) is preferred.

The present invention creates a firearm barrel with a higher stiffness-to-weight ratio than a traditional barrel made from one material. The high flexural rigidity, high tensile and compressive strength, and excellent impact resistance is superior to current mono-core and composite barrels currently on the market today. Commercial applications would include, but are not limited to, OEM firearm manufacturing as well as any industry requiring rigid, lightweight barrels that withstand high internal forces. Military applications would not only include handheld firearms but also any firearm in which weight reduction would be beneficial. Firearms and artillery transported by vehicle would realize a reduction in fuel and vehicle fatigue by transporting less mass. Reducing repetitive stress and fatigue from moving heavy equipment would improve morale and soldier efficiency.

Currently, low-cost weight reduction is accomplished by producing a thin carbon steel or stainless-steel barrel. As these barrels are shot, accuracy and barrel life are diminished due to metal fatigue. Barrels of this nature lose accuracy as the material temperature rises and the barrel cannot support its own structure. The muzzle of the barrel begins to droop, point further downward, and projectiles no longer impact where the shooter is aiming.

Presently, the manufacture of carbon composite firearm barrels is time-consuming and expensive. While carbon winding technology has allowed for the automation of the application of carbon filament, finish work must be done by hand. Additionally, carbon composite barrel technology requires the steel or stainless-steel core to be machined to a small diameter, which requires specialized tooling and processes to prevent the barrel from becoming warped or damaged in the production cycle. Furthermore, carbon fiber is an excellent insulator and can trap heat in the core barrel material. Because heat is one of the three core causes of metal fatigue in firearm barrels, trapped heat is less than ideal for longevity, accuracy, and consistency.

The present invention can be manufactured in an automated line and does not require hand finishing. The first two layers are easily machined without the risk of compromising the integrity of the barrel. The third layer can be easily machined in an automated manufacturing line and is quickly bonded to the first two layers. The combination of ease of manufacturing and superior performance makes the present invention truly unique in the marketplace.

B. Detailed Description of the Figures

Figure 2:
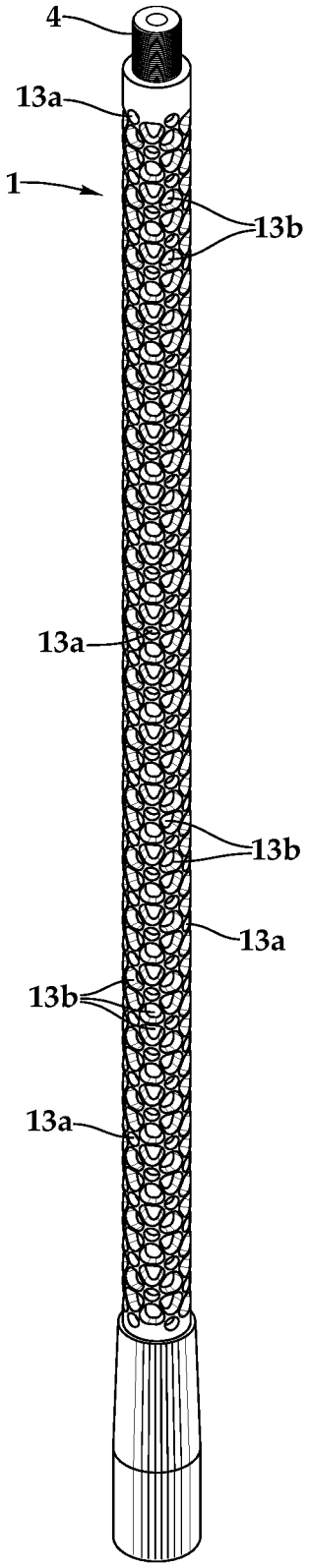
FIG. 2 is a perspective view of the present invention shown with the shroud removed.
Figure 13:
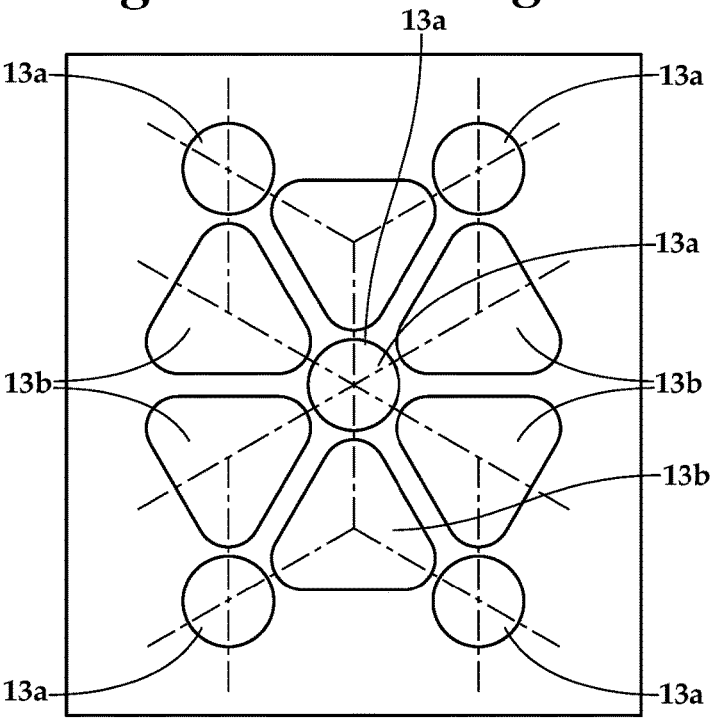
FIG. 13 is a pattern view of a single array in the grid pattern of the present invention.

FIG. 1 is a perspective view of the present invention shown fully installed, and FIG. 2 is a perspective view of the present invention shown with the shroud removed. As shown in these two figures, the present invention comprises an inner layer 1 (also referred to as the "core") and an outer layer or shroud 2. The shroud 2 is preferably a cylindrical tube made of titanium. The inner layer 1 is preferably comprised of steel. The inner layer 1 starts as a steel tube into which the grid pattern shown in FIG. 13 is carved by a computer numerical control (CNC) machine. This grid pattern is overlaid on the cylindrical outer surface of the inner layer 1, as shown in detail in FIG. 3.

Figure 3:
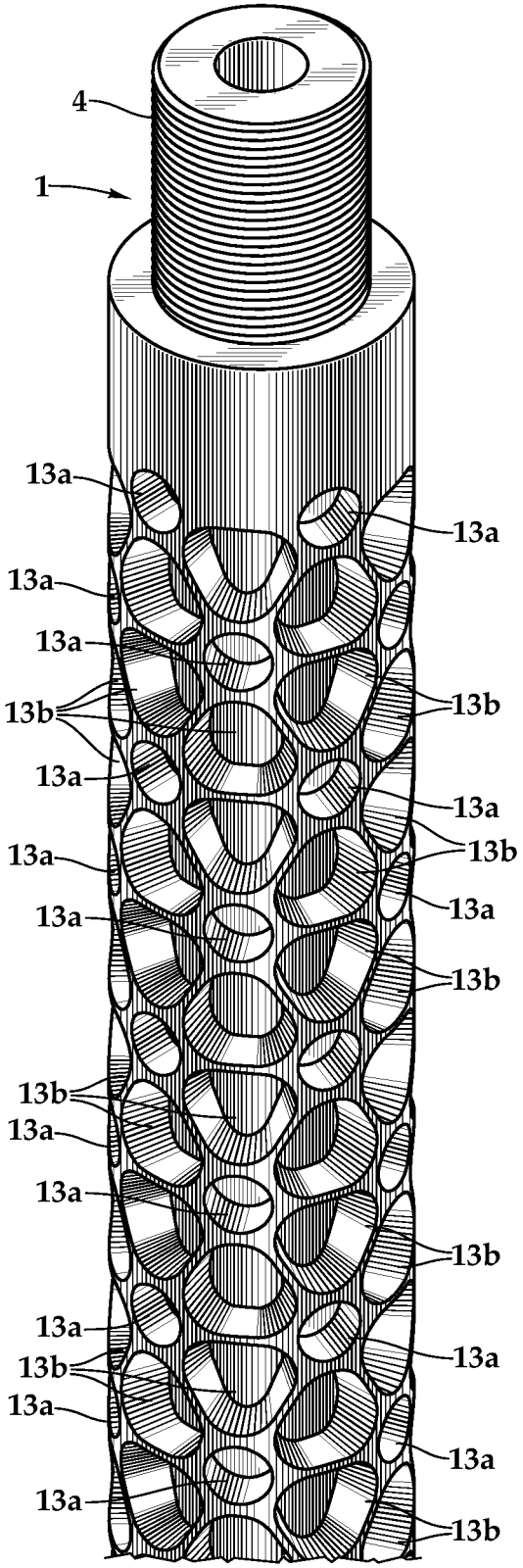
FIG. 3 is a detail perspective view of the muzzle end of the present invention.
Figure 14:
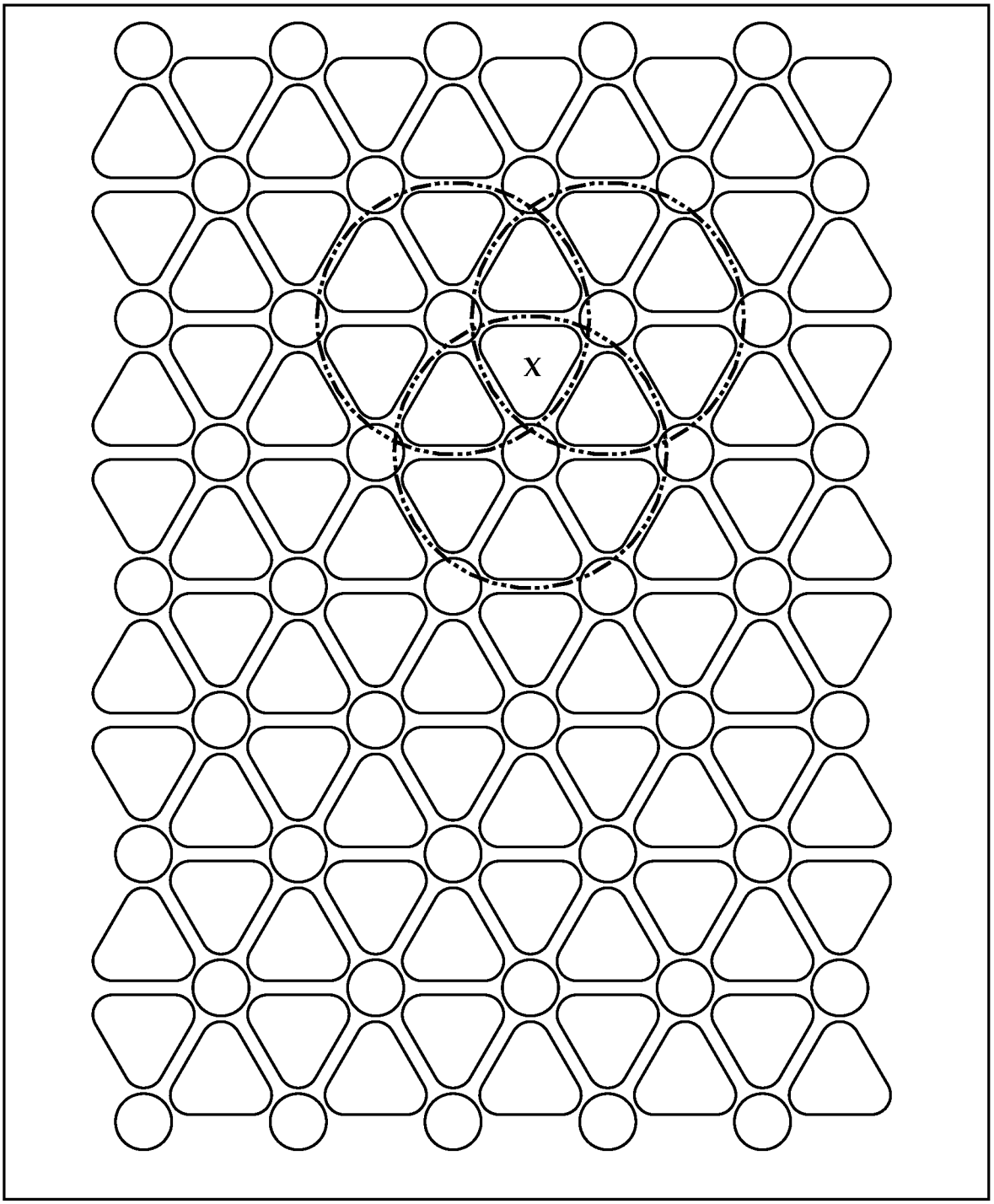
FIG. 14 is a pattern view of the repeating and overlapping arrays in the grid pattern of the present invention.

FIG. 3 is a detail perspective view of the muzzle end of the present invention. The grid pattern that is carved into the inner layer 1 is comprised of a repeating series of arrays, each array being comprised of a central circle 13*a* surrounded by six equally spaced equilateral triangles 13*b* in which all three sides of the triangle are equal (see FIG. 13). The three points within each triangle at which each side of the triangle joins an adjacent side of the triangle (also referred to as the triangle "tips") are preferably rounded so as to avoid having any sharp edges, which can create fault lines. This grid pattern is repeated in an overlapping manner so that each individual triangle (marked as "X" in FIG. 14) forms a part of three separate "arrays" (see dotted circles in FIG. 14). A circle is situated at each of the three tips of each triangle and aligned with the axis of symmetry of each adjacent triangle (see dotted lines in FIG. 13). Within this overlapping grid pattern, each circle 13*a* is always (except at the longitudinal ends of the pattern) surrounded by six equilateral triangles 13*b*, and there is a circle 13*a* located at each tip of each triangle 13*a*. The ratio of circles to triangles in this grid pattern is 1:2.

Figure 4:
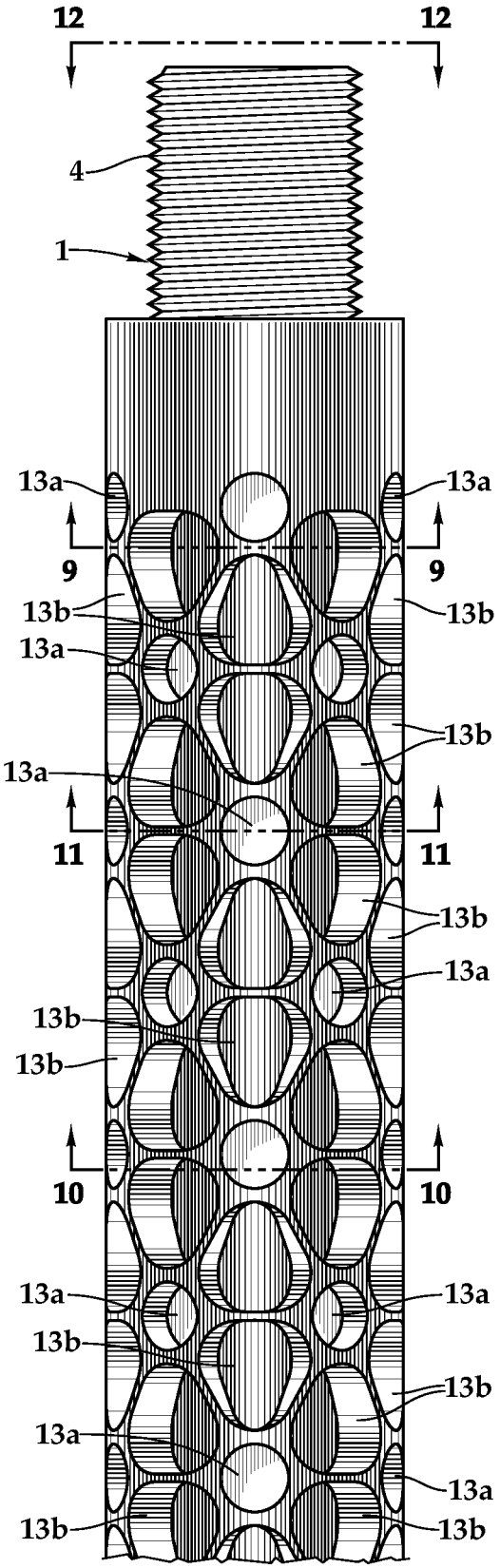
FIG. 4 is a top detail view of the muzzle end of the present invention.

FIG. 4 is a top detail view of the muzzle end of the present invention. As shown in this figure, each of the triangles and circles that comprise the grid pattern shown in FIG. 13 is cut into the inner layer 1, thereby creating a floor and contiguous side walls within each cutout. In the embodiment shown in the figures, the circles are straight punches into the core, with a flat floor 13 and side walls that are not angled (see also FIGS. 9 and 11). In a preferred embodiment, the floor of each triangle 13*b* is curved to match the curvature of the central bore 3 in the inner layer 1 (see also FIGS. 9 and 10). The central bore 3 is configured to allow passage of a projectile through it, as in a firearm. Although the muzzle end of the firearm barrel is shown as threaded in the figures, the present invention is not limited to any particular shape or configuration of the muzzle or breech end of the barrel. The present invention may be used in connection with any elongated firearm barrel.

Figure 5:
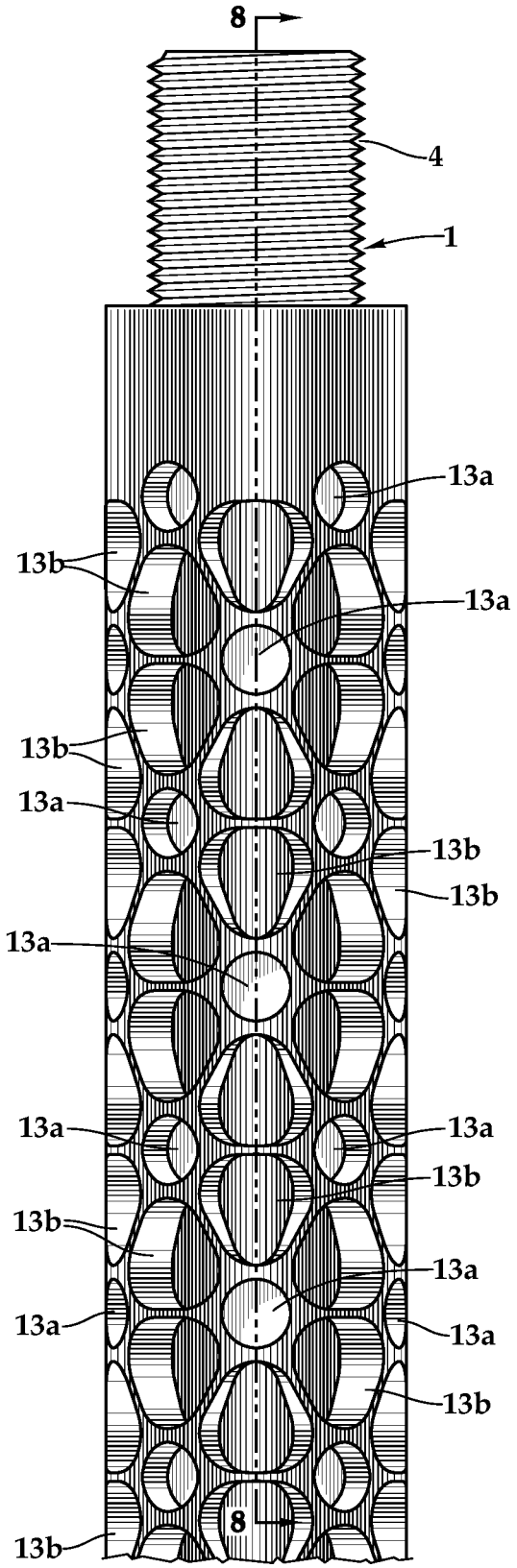
FIG. 5 is a bottom detail view of the muzzle end of the present invention.

FIG. 5 is a bottom detail view of the muzzle end of the present invention. In this figure, the barrel has been rotated one hundred eighty degrees (180°) from what is shown in FIG. 4. The walls of the triangular cutouts 13*b* are perpendicular to the outer circumference of the barrel (or to the inner surface of the central bore 3) at all times. In a preferred embodiment (shown in the figures), the walls of the circular cutouts 13*a* are parallel to the radius extending from the center of the bore 3 to the center of each circular hole, and the floor of the circular cutouts 13*a* is perpendicular to this same radius. In an alternate embodiment (not shown in the figures), the walls of the circular cutouts 13*a* are perpendicular to the outer circumference of the barrel, and the floor of the circular cutouts 13*a* is concentric with the central bore 3.

Figure 6:
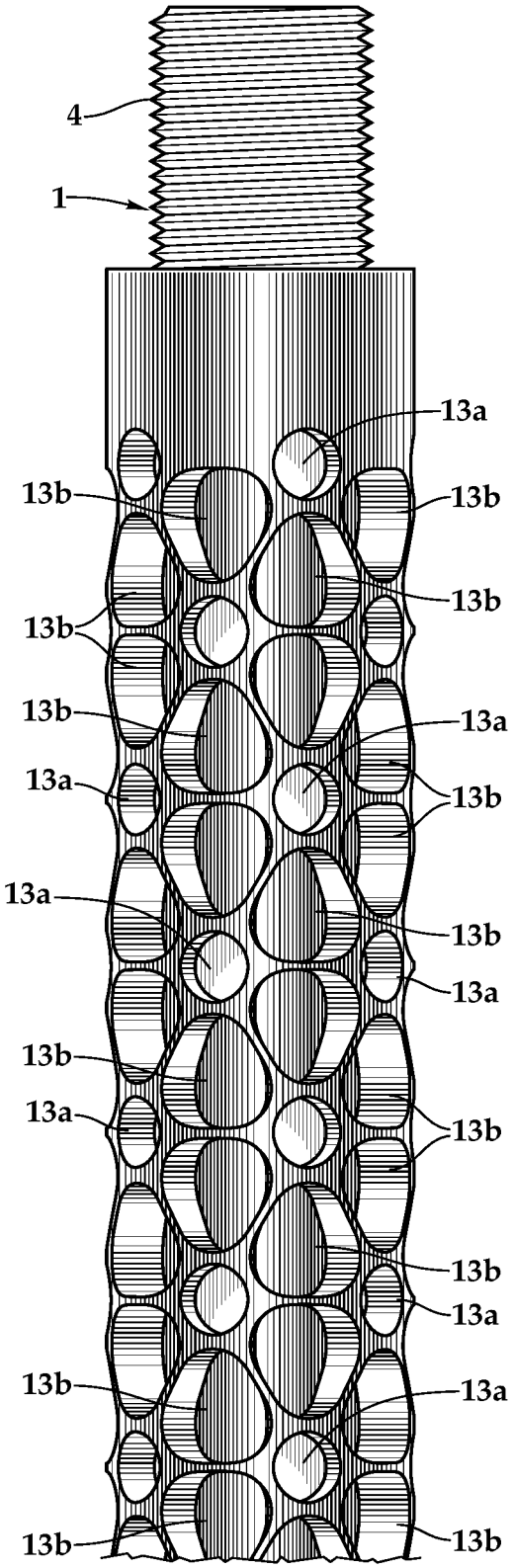
FIG. 6 is a first side detail view of the muzzle end of the present invention.
Figure 7:
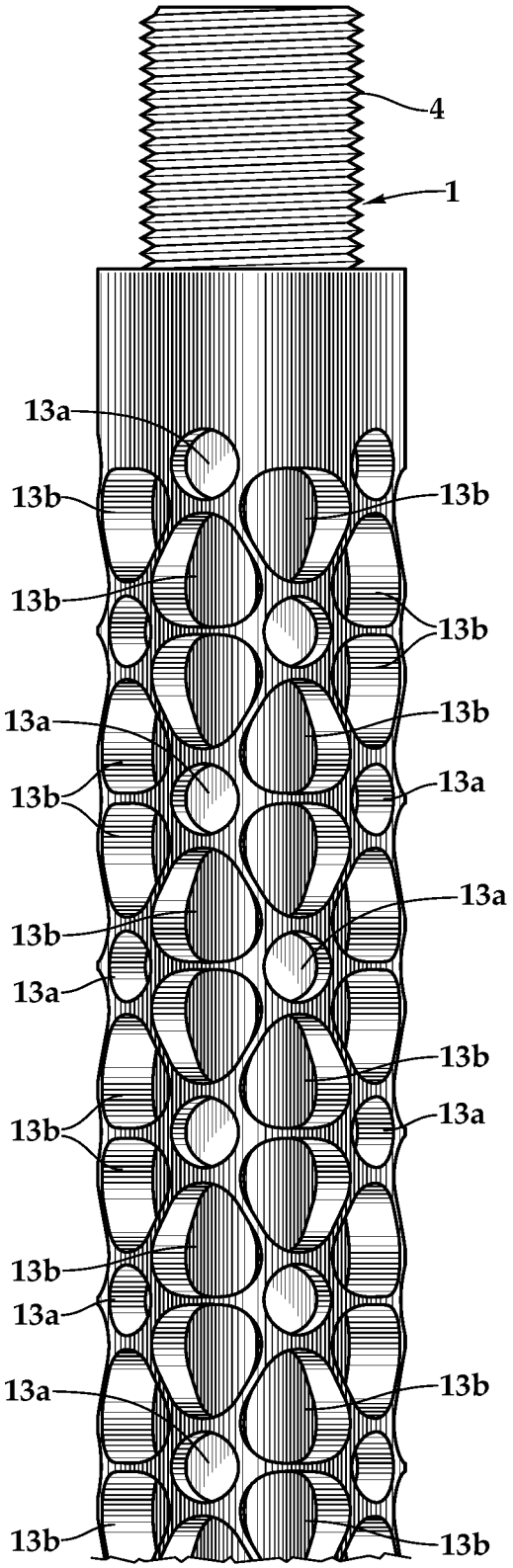
FIG. 7 is a second side detail view of the muzzle end of the present invention.

FIG. 6 is a first side detail view of the muzzle end of the present invention. In this figure, the barrel has been rotated ninety degrees (90°) in a first direction from what is shown in FIG. 4. FIG. 7 is a second side detail view of the muzzle end of the present invention. In this figure, the barrel has been rotated ninety degrees (90°) in a second direction from what is shown in FIG. 4. These two figures further illustrate the features of the invention described above. Through experimentation over a period of years, it was determined that the circular cutouts 13*a* reduce the overall weight of the barrel, while the triangular cutouts 13*b* create ridges between them that provide the necessary structural integrity for the barrel.

Figure 8:
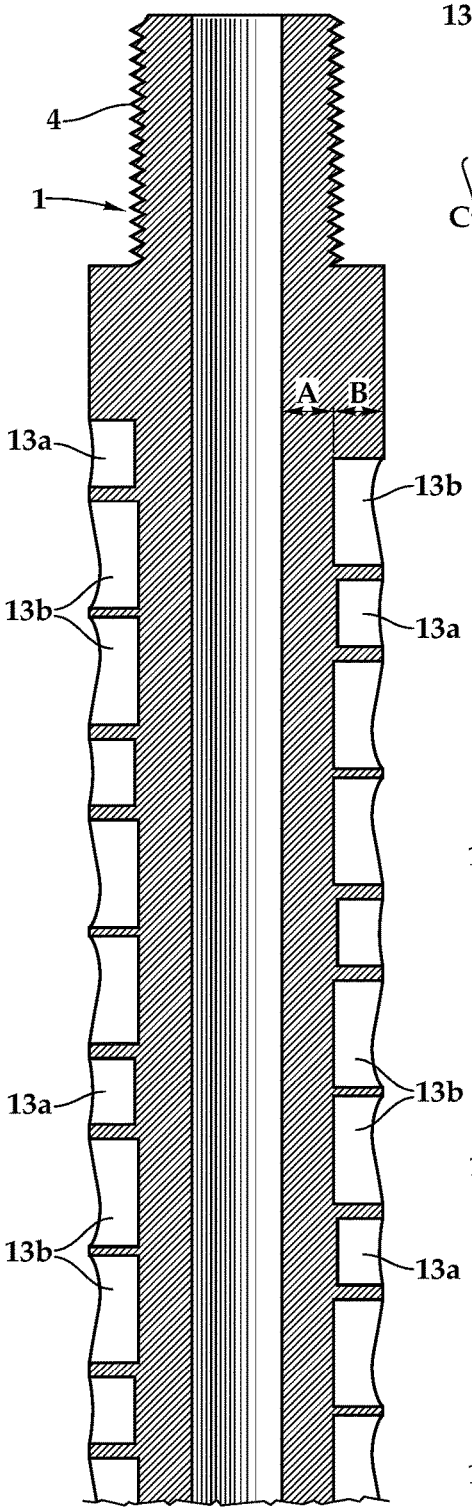
FIG. 8 is a longitudinal section view of the muzzle end of the present invention.

FIG. 8 is a longitudinal section view of the muzzle end of the present invention. As shown in this figure, in a preferred embodiment, the floor of each circle 13*a* is slightly shallower (that is, less deep) than the floor of each triangle 13*b*. This figure also shows that when a longitudinal section is taken through the center of the barrel and through the center of the longitudinally aligned triangles/circles, the grid pattern is a repeating series of a single circle followed by a pair of back-to-hack triangles except at the ends of the barrel (at which the repeating pattern is interrupted). In a preferred embodiment, the thickness of the unperforated core (that is, that part of the core into which the circular and triangular cutouts do not extend, designated as "A" in FIG. 8) is at least equal to the radius of the central bore 3 (marked as "y" in FIG. 12). The unperforated core (designated as "B" in FIG. 8) directly surrounds the central bore 3, as shown; however, the perforated core and unperforated core are comprised of the same material and constitute a single part.

Figure 9:
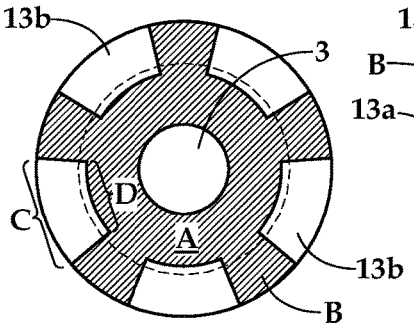
FIG. 9 is a first lateral section view taken at the line shown in FIG. 4.

FIG. 9 is a first lateral section view taken at the line shown in FIG. 4. This figure shows only the triangles 13*b* in the perforated core "B." It shows the curved floor of each triangle and the fact that the curvature of the triangle floor matches that of the central bore 3, which is concentric. In this section view, the walls of the triangles are splayed outwardly so that the ratio of the length of the arc at the outer periphery of the triangle ("C") to the length of the arc at the triangle floor ("D") is greater than 1:1. The precise ratio is dependent on the outside diameter and caliber of the barrel.

Figure 10:
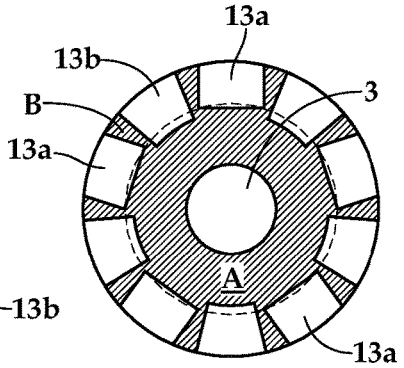
FIG. 10 is a second lateral section view taken at the line shown in FIG. 4.

FIG. 10 is a second lateral section view taken at the line shown in FIG. 4. This figure shows both the circular cutouts 13*a* and the triangular cutouts 13*b*. As noted above, regardless of where the section is taken in FIG. 4, the walls of the triangular cutouts 13*b* are perpendicular to the outer circumference of the barrel. This is also illustrated in FIG. 8.

Figure 11:
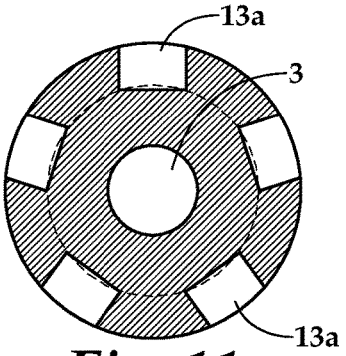
FIG. 11 is a third lateral section view taken at the line shown in FIG. 4.

FIG. 11 is a third lateral section view taken at the line shown in FIG. 4. This figure shows only the circular cutouts 13*a* in the perforated portion "B" of the core 1. As noted above, in this particular embodiment, the circular cutouts 13*a* have flat floors and walls that are parallel to the radius extending from the center of the bore 3 to the center of each circular hole. Preferably, the circular cutouts 13*a* are not as deep as the triangular cutouts 13*b* to avoid overlap between the two. The degree of proximity between the cutouts—more specifically, the thickness of the ridges created by the triangular cutouts—is dependent on the particular application. For example, a tank barrel may require relatively thicker ridges than a rifle barrel.

Figure 12:
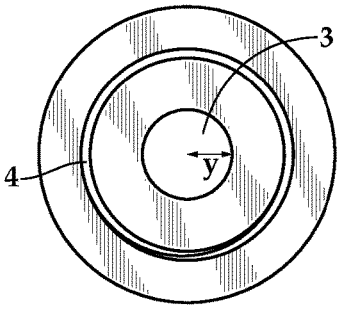
FIG. 12 is a top view taken from the perspective shown by the line in FIG. 4.

FIG. 12 is a top view taken from the perspective shown by the line in FIG. 4. This figure shows the threaded muzzle end 4 of the barrel, although, as noted above, the present invention is not limited to any particular configuration of the muzzle or breech end of the barrel.

Figure 15:
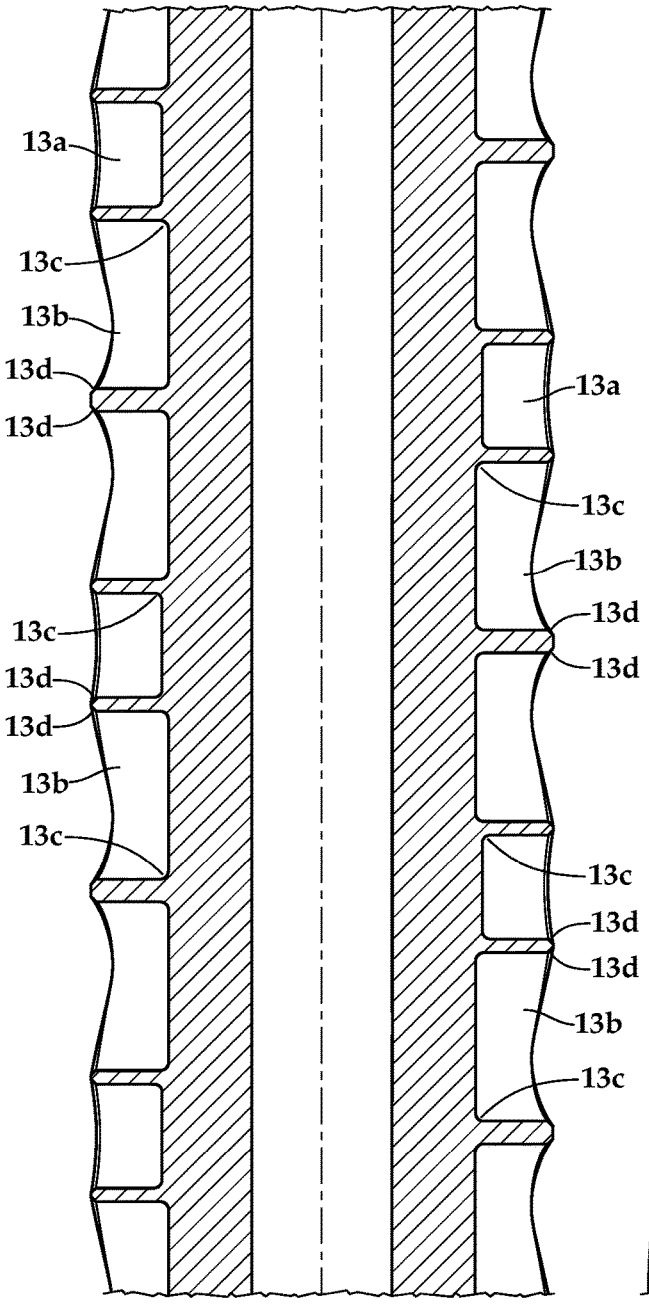
FIG. 15 is a longitudinal section view of the muzzle end of an alternate embodiment of the present invention.
Figure 16:
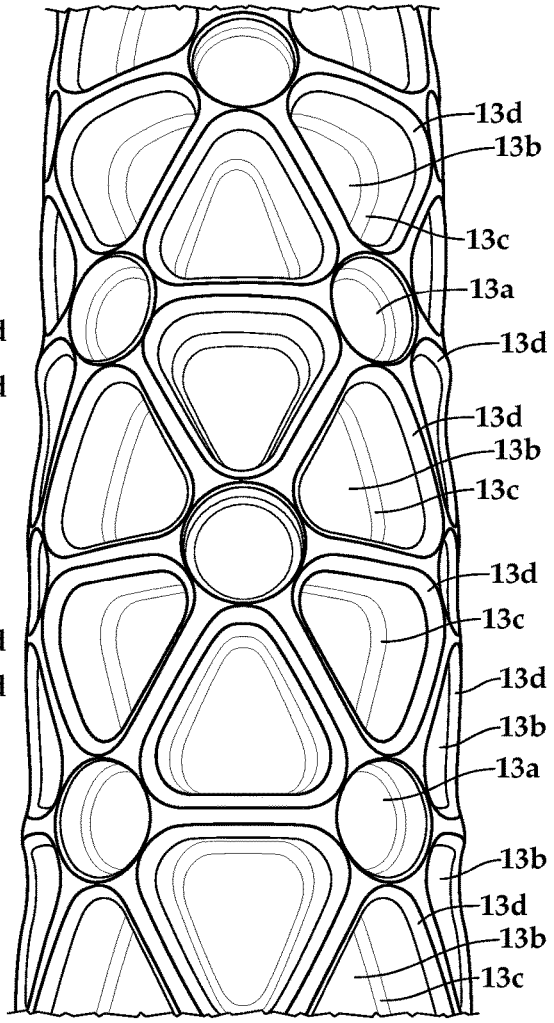
FIG. 16 is a detail view of an alternate embodiment of the present invention.

Optionally, the floor of each triangular cutout 13*b* may include a fillet 13*c* that extends around the perimeter of the floor of each triangular cutout, as shown in FIGS. 15 and 16. In the same alternate embodiment, each triangular cutout 13*b* may include a chamfer 13*d* that extends around the top edge of each triangular cutout 13*a*. This chamfer is preferably at a forty-five-degree (45°) angle relative to the wall of the triangular cutout 13*b*.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A firearm barrel comprising:

an inner layer; and a shroud;

wherein the inner layer surrounds a concentric bore and has an outer diameter;

wherein the inner layer comprises an unperforated core that directly surrounds the concentric bore and a perforated core that surrounds the unperforated core;

wherein the shroud surrounds the perforated core; and wherein the perforated core is comprised of a plurality of equilateral triangular cutouts and a plurality of circular cutouts in a grid pattern that is configured to form structural ribs between the unperforated core and the outer diameter of the inner layer;

wherein the grid pattern is comprised of a repeating and overlapping series of arrays;

wherein each array is comprised of a central circular cutout surrounded by six equally spaced equilateral triangular cutouts, each of the equilateral triangular cutouts having three tips;

wherein a circular cutout is situated at each of the three tips of each equilateral triangular cutout; and wherein each circular cutout is aligned with an axis of symmetry of each of the equilateral triangular cutouts.

2. A firearm barrel comprising:

an inner layer; and a shroud;

wherein the inner layer surrounds a concentric bore and has an outer diameter;

wherein the inner layer comprises an unperforated core that directly surrounds the concentric bore and a perforated core that surrounds the unperforated core;

wherein the shroud surrounds the perforated core; and wherein the perforated core is comprised of a plurality of equilateral triangular cutouts and a plurality of circular cutouts in a grid pattern that is configured to form structural ribs between the unperforated core and the outer diameter of the inner layer;

the barrel having an outer circumference;

wherein each of the equilateral triangular cutouts has a floor and three contiguous side walls;

wherein the floor of each equilateral triangular cutout is concentric with the bore; and wherein the contiguous side walls of the equilateral triangular cutout are perpendicular to the outer circumference of the barrel.

3. A firearm barrel comprising:

an inner layer; and a shroud;

wherein the inner layer surrounds a concentric bore and has an outer diameter;

wherein the inner layer comprises an unperforated core that directly surrounds the concentric bore and a perforated core that surrounds the unperforated core;

wherein the shroud surrounds the perforated core; and wherein the perforated core is comprised of a plurality of equilateral triangular cutouts and a plurality of circular cutouts in a grid pattern that is configured to form structural ribs between the unperforated core and the outer diameter of the inter layer;

wherein the floor of each circular cutout is shallower than the floor of each equilateral triangular cutout.

* * * * *